United States Patent [19]

Gosling et al.

[11] Patent Number: 4,560,965

[45] Date of Patent: Dec. 24, 1985

[54] MOUNTING DIELECTRIC RESONATORS

[75] Inventors: Ian G. Gosling, Ipswich; Richard D. Carver, Felixstowe, both of England

[73] Assignee: British Telecommunications plc, London, England

[21] Appl. No.: 672,235

[22] Filed: Nov. 16, 1984

[30] Foreign Application Priority Data

Nov. 21, 1983 [GB] United Kingdom ..... 8331051

[51] Int. Cl.[4] ..... H01P 7/00; H01P 7/04; H01P 1/207

[52] U.S. Cl. ..... 333/219; 333/202; 333/208; 333/227

[58] Field of Search ..... 333/202, 204, 205, 208–212, 333/219, 227, 235, 236, 245, 246, 238, 239, 240; 29/600; 331/96, 107 DP, 107 SL

[56] References Cited

U.S. PATENT DOCUMENTS

| | | | |
|---|---|---|---|
| 2,852,752 | 9/1958 | McCreary | 333/115 X |
| 2,931,992 | 4/1960 | Caroselli | 333/227 |
| 3,128,439 | 4/1964 | Brown, Jr. et al. | 333/115 X |
| 3,594,667 | 7/1971 | Joseph | 333/251 |
| 3,740,675 | 6/1973 | Moore et al. | 333/205 |
| 4,321,568 | 3/1982 | Joyal et al. | 333/209 |

FOREIGN PATENT DOCUMENTS 279127 3/1952 Switzerland .

OTHER PUBLICATIONS

IEEE Transactions on Microwave Theory and Techniques, vol. MTT-29, No. 4, Apr. 1981, pp. 323–326, New York, (U.S.), R. R. Bonetti et al: "Designe of Cylindrical Dielectric Resonators in Inhomogeneous Media."

"Application of Dielectric Resonators in Microwave Components"—IEEE Transactions on Microwave Theory and Techniques, vol. MTT-29, No. 8, Aug. 1981.

*Primary Examiner*—Marvin L. Nussbaum

*Attorney, Agent, or Firm*—Cushman, Darby & Cushman

[57] ABSTRACT

A microwave dielectric resonator, e.g. for use in a microwave filter or oscillator, is provided with a tough low loss mount. The mount comprises a polymeric support layer 4, which is provided with an aperture 3 beyond which the resonator extends. About the first polymer layer 4 are a pair of polymeric retaining layers 2, 2'. These three polymer layers may be heat bonded together to secure the resonator. Interlayers 5 may be used between the three polymer layers 4, 2, 2' in order to effect a bond.

12 Claims, 6 Drawing Figures

MOUNTING DIELECTRIC RESONATORS

This invention relates to dielectric resonators for use with microwaves, and in particular to the mounting of such resonators.

This application is related to the copending commonly assigned application Ser. No. 523,059 filed Aug. 15, 1983 and naming William Thorpe as inventor. This related earlier-filed application discloses a dielectric resonator which is also mounted and supported in position between laminated sheets of polymeric material having low dielectric constant.

Dielectric resonators, made from materials having a high dielectric constant (usually between about 30 and 40), are used within microwave systems in, amongst other things, filter and oscillator circuits. For any given frequency, a dielectric resonator is much smaller than the equivalent cavity resonator which it may replace. Whenever a dielectric resonator is used in a microwave system, whether in waveguide or microstrip applications, it is necessary to mount the resonator. It is known to bond dielectric resonators to a supporting substrate such as alumina by means of a glue or adhesive. It is also known to mount dielectric resonators within machined supports, as is shown for example in the review paper entitled "Application of Dielectric Resonators in Microwave Components" by James K Plourde and Chung-Li Ren, published in IEEE Transactions on Microwave theory and techniques; Vol. Mtt-29, No. 8 August 1981, the disclosure of which is herein incorporated by this reference.

Both these known techniques introduce losses, which may be considerable.

In general, glues and adhesives are strong absorbers of microwaves, and hence cause appreciable loss even in the small quantities which are used to bond a resonator to a substrate.

Where the resonator is to be mounted within a waveguide, resonator supports machined to accept the resonator are generally quite bulky and may consequently cause appreciable loss, particularly where the dielectric constant of the support material (usually in the range 2 to 10) is much in excess of 1. Such supports also lead to unwanted disturbance of the symmetry of the field distributions, for which it is difficult to compensate. Furthermore, both the above techniques provide assemblies which are not particularly robust and which are sensitive to severe mechanical shock and vibration.

We have devised a technique which enables dielectric resonators to be mounted to form assemblies which are particularly resistant to vibration and severe mechanical shocks. It has been found that the stability and resistance to warping and other distortion of assemblies produced using some mounting techniques are adversely affected by the elevated temperatures to which they may be expected to be exposed in use. Stability is required of the mounting as, in many applications, the position of the dielectric resonator has a considerable effect on performance. It is important when the resonator is mounted in a waveguide for instance, that the resonator is in a well defined position relative to the walls of the waveguide and any change in this position is likely to adversely affect performance.

The present technique allows the production of resonator assemblies which are stable even under conditions of elevated temperature.

According to a first aspect of the present invention there is provided a dielectric resonator mount having a laminar structure which comprises a polymeric support layer between two polymeric retaining layers wherein the support layer includes an aperture within which is located a dielectric resonator.

According to a further aspect of the present invention there is provided a microwave resonant cavity comprising a laminar structure according to the invention.

Figure 1:
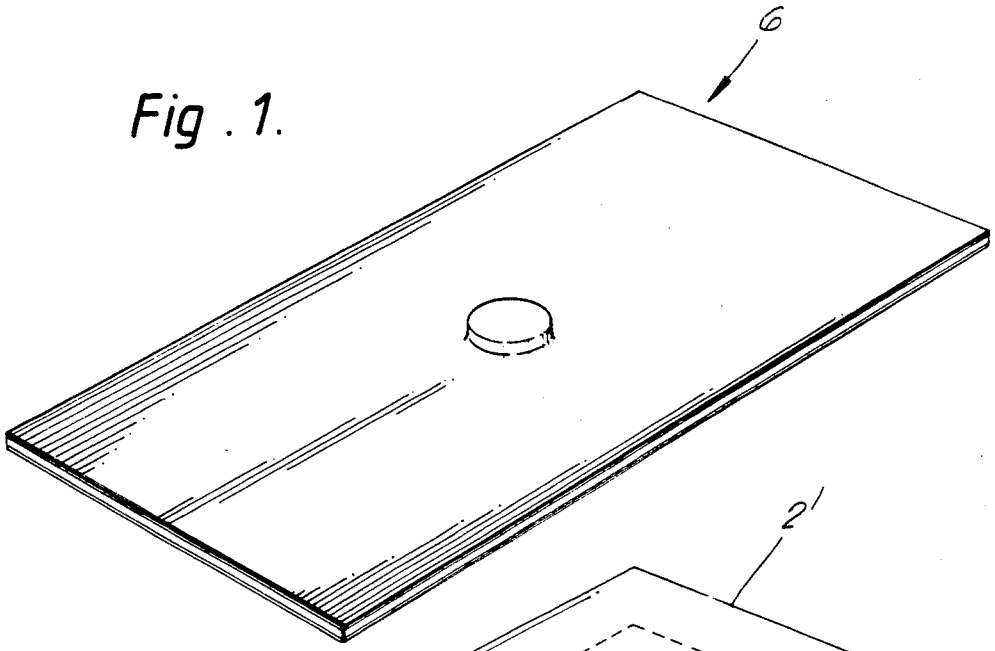
FIG. 1 is a perspective view of an assembly comprising a dielectric resonator mounted between a pair of low loss substrates using the method according to the present invention.
Figure 2:
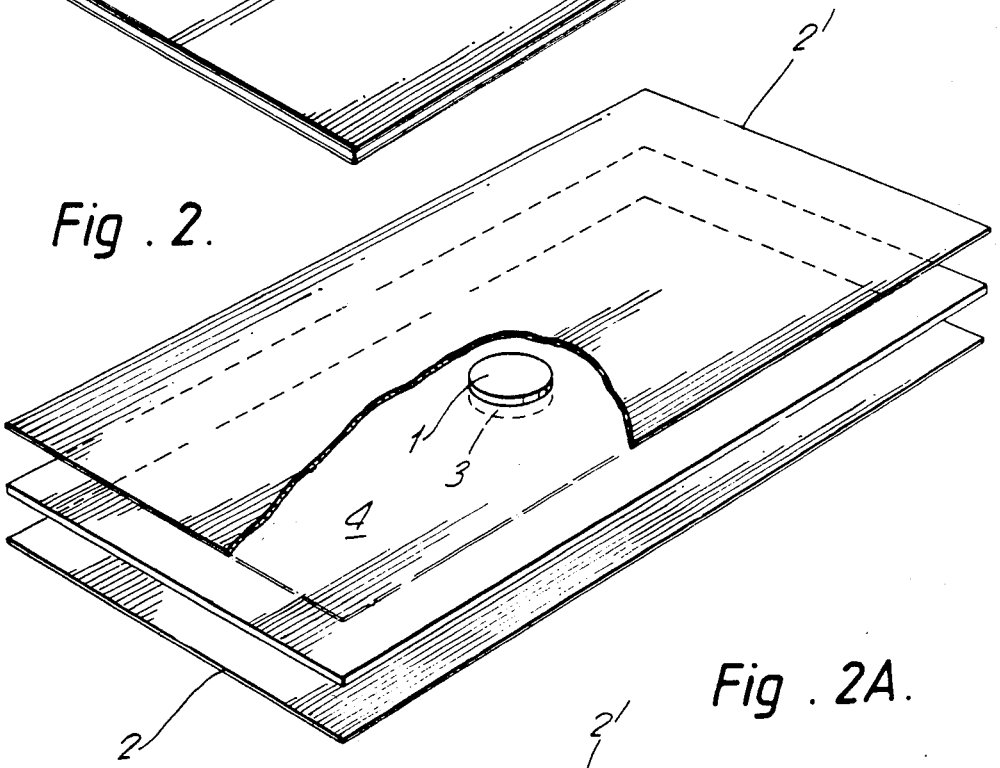
FIG. 2 is a perspective view of the components of the assembly of FIG. 1 prior to lamination.
Figure 2A:
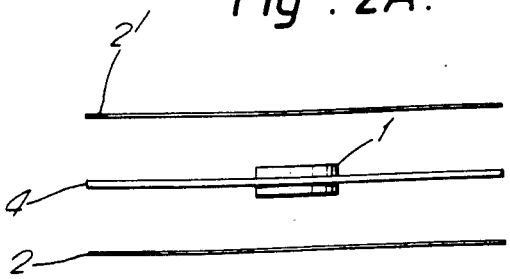
FIG. 2A is an end elevation of the components of FIG. 2.

Referring now to FIGS. 1 and 2, a dielectric resonator 1 is positioned between two thin retaining sheets 2, 2' of low dielectric constant material, and passes through an aperture 3 provided in a further, support sheet 4 of low dielectric constant polymeric material between retaining sheets 2, 2'. The dielectric resonator may be made of any suitable material and will typically have a dielectric constant of about 30 to 40, the ceramic barium nonatitanate ($Ba_2Ti_9O_{20}$) is an example of such a material, but suitable alternatives will be known to those skilled in the art.

The resonator is shown as being of a circular 'pill' form although other forms known to those skilled in the art may be used.

As is also known to those skilled in the art, the resonator must have dimensions suited to the frequency of the radiation with which it is to be used. For X band (8–12 GHz) the resonator might be of the order of 4.8 mm diameter by 1.8 mm length, while for Q band (26–40 GHz) suitable dimensions might be 2 mm diameter by 0.8 mm length.

In order to minimise the quantity of loss inducing material used in forming the mount, the thicknesses of the sheets 2, 2' and 4, are kept to a minimum. However, when the laminate is to be used at elevated temperature, it is generally necessary to increase the thickness of the sheets. If the thickness is to be increased, it is convenient to increase the thickness of the central, support sheet 4 while maintaining the outer, retaining sheets at minimal thickness.

Lamination of the three sheets 2, 2', 4 is preferably accomplished without the use of microwave absorbing glues or adhesives (such as epoxy resins) in order to avoid the losses which such materials introduce. In order to effect the lamination the sheets are preferably bonded together with the application of heat and pressure.

As the dielectric resonator may be of quite considerable bulk (i.e. up to about 5 mm diameter and 2 mm length for 9 GHz resonators), certainly in comparison to the substrate thickness ($\simeq$80 $\mu$m for 2 and 2' and $\simeq$250 $\mu$m for 4), it is generally necessary to apply the pressure needed to effect bonding through co-operating formers having recesses into which the resonator may be received during lamination. It is in general not necessary to exclude air from between the substrates when making the laminate, provided that the resulting laminate sufficiently retains the resonator and provided that the laminate is not likely to catastrophically delaminate during its expected lifetime. If the encapsulated resonator is to be used in an environment where it will be exposed to elevated temperature and/or reduced atmospheric pressure, any gasses entrapped during the encapsulation process are likely to expand, which could cause a catastrophic failure of the encapsulation. For this reason it is preferable to minimise the amount of gas entrapped during encapsulation.

The selection of a specific polymer for use in the method will depend largely on its physical properties. Among the most important of these properties are the electrical characteristics, thermal properties, and those properties governing the ability to form a bond, between a first layer of that material and a further layer, without the use of microwave absorbing (and hence loss inducing) materials such as adhesives. Generally, when selecting a material for any particular application, advantages in respect of some of the properties will have to be balanced against disadvantages in respect of other properties. For example, the polymers which most easily heat soften and which are correspondingly easy to heat bond, tend to have non-optimum electrical properties, e.g. undesirably high dielectric constants. Conversely, those polymers such as P.T.F.E. (polytetrafluoroethylene), which have particularly desirable electrical properties may not be heat bondable directly because they do not heat soften.

With a material such as P.T.F.E. which does not readily heat soften, or a material such as oriented P.E.T. (poly(ethylene tetephthalate)) film, which may permanently lose considerable strength on being heated to near its softening point, it may be possible to produce what is in effect a self-bond, by the use of an interlayer 5, between the various other layers, which is more readily heat softenable. The heat softenable interlayer 5 may be a co-polymer having a monomer common to the principal layers, and having a lower heat-softening temperature. Clearly, where stability at high temperature (such as the 128° C. required by some MIL specifications) is required it will probably be necessary to use a polymer with which an interlayer is needed. With P.T.F.E., Du Pont's F.E.P., and 3M's 6700 film (copolymers of P.T.F.E.) have both been found to be suitable.

As the interlayer need only be very thin, it is not essential that its electrical properties or physical properties be as good as those of the principal layers, provided that the resultant laminates's electrical and physical properties are satisfactory. However, in order for the laminate to satisfy the general requirement of low introduced loss it is preferable for the interlayer to be of a low loss material; conventional glues and adhesives cannot satisfactorily be used.

Figure 3:
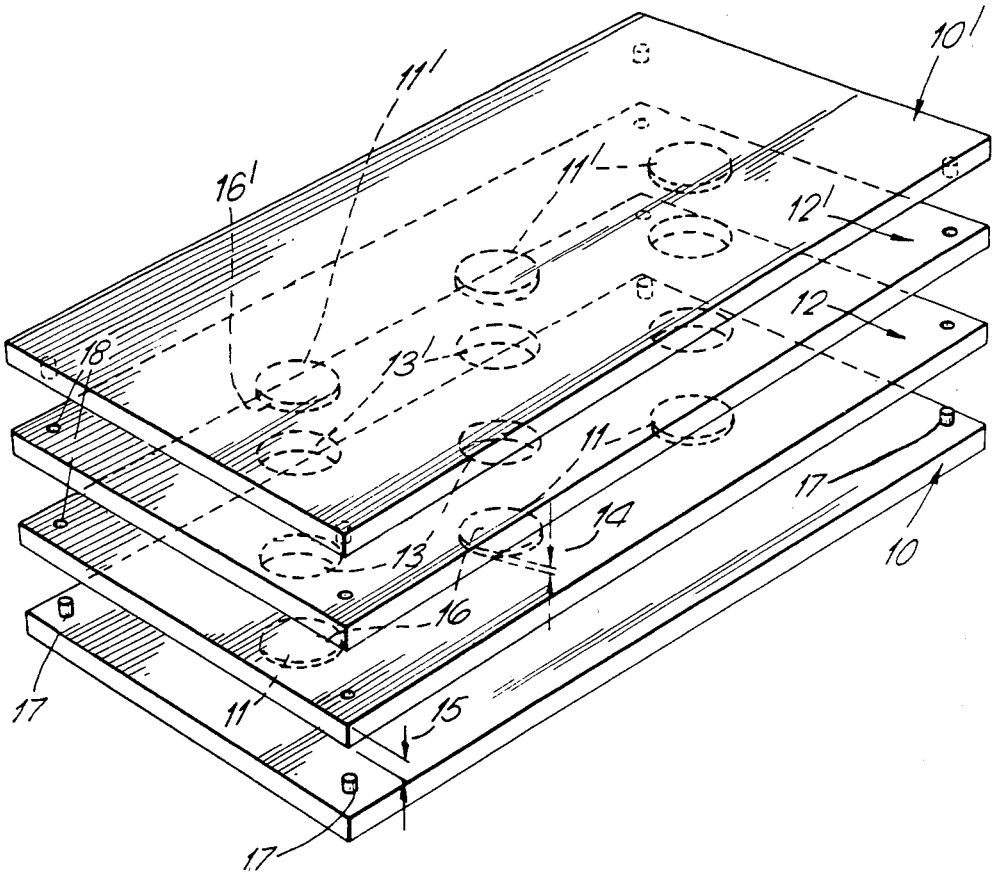
FIG. 3 is a perspective view of a jig suitable for use in the lamination process.
Figure 4:
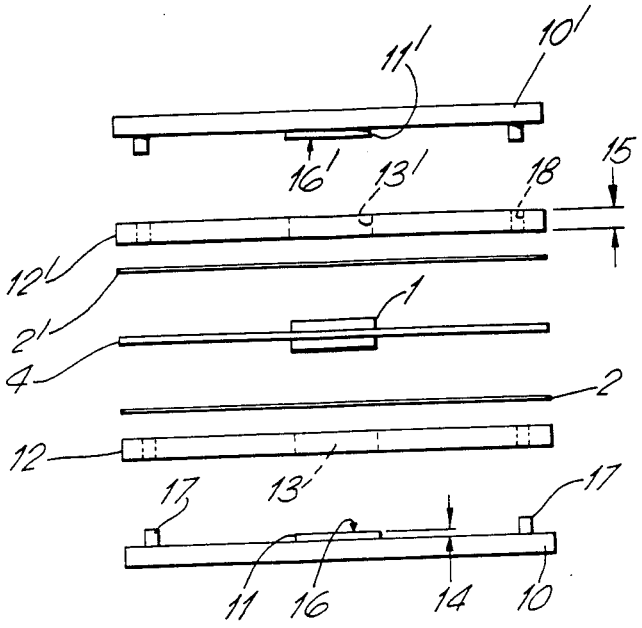
FIG. 4 is an end elevation of the jig of FIG. 3.

The laminate illustrated in FIG. 1 has been formed with the resonator centrally located between the outer sections 2, 2'. The central location is preferred as it enables the resonator to be more easily located in the centre of a microwave cavity where housing effects and temperature fluctuations are minimised. FIGS. 3 and 4 show a jig in which a laminate may be produced. The jig comprises four plates; a pair of backing plates 10 and 10', and a pair of former plates 12 and 12' lying between the backing plates. Each backing plate is provided on one face with spigots 11 which co-operate with corresponding holes 13 in their respective former plates. The jig shown is intended for the production of laminates containing up to three resonators, their being three spigots spaced along the centre line of each backing plate and three holes in corresponding positions in each former plate. The height 14 of the spigots is less than the thickness 15 of the former plates 12 such that when the jig is assembled there is sufficient clearance between the opposing faces 16 and 16' of the spigots to accommodate a resonator. In addition to the spigots 11 and holes 13, the plates 10 and 12 may be provided with locating lugs 17 and 17' and sockets 18 and 18' to ensure accurate registration of the jig components when assembled.

Figure 5:
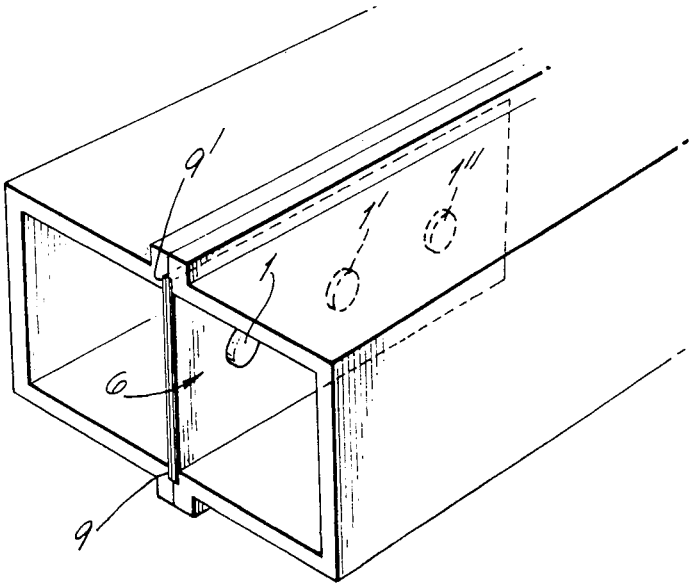
FIG. 5 shows how a laminated assembly may be mounted in a waveguide.

In FIG. 5 a laminate 6 containing three dielectric resonators, 1, 1', and 1'' is shown secured within a waveguide to produce a tuned cavity. The resonant frequency of the cavity is governed by the particular dielectric resonator or resonators chosen. The laminate 6 should be securely mounted within the waveguide to prevent its coming loose in the event of the waveguide, being subjected to a severe mechanical shock. Preferably, the resonator or resonators are mounted centrally within the waveguide. More preferably the axis of the waveguide passes through the resonator or resonators. The laminate may be secured between grooves 9, 9' in the walls of the waveguide as shown, or in some other way which introduces the minimum amount of lossy material. If the laminate is securely mounted within the waveguide, the laminate's inherent toughness and resistance to shocks may be fully exploited in helping to make the equipment in which it is contained considerably less sensitive to shocks than is equipment which contains conventional resonator assemblies.

The potential advantages of the technique include:

- the possibility of reducing loss caused by the presence of the mounting material, as the mount may be thinner and use less material than heretofore;
- the possibility of eliminating loss caused by the presence of microwave absorbing glues or adhesives;
- the possibility of increasing the shock resistance of the laminate as compared to assemblies where the resonators are mounted conventionally.

The reduction of loss due to the mounting material is a result of the reduction in thickness possible over previous structures. Preferably the retaining layers 2 and 2' are of substantially equal thickness, which is preferably less than 150 μm. More preferably the retaining layers have a thickness of 100 μm or less. Preferably the support layer has a thickness of between about 150 and 300 μm.

As no glues or adhesives need be used during lamination they need contribute no loss.

Where the laminate is adequately bonded it should be considerably more rugged than machined resonator assemblies.

A material which has been found to be suitable for lamination to mount dielectric resonators is glass reinforced sheet P.T.F.E. sold under the trade name RT Duroid. RT Duroid is available in the US from Rogers Corporation, Box 700 Chandler, Ariz., 85224, and in the UK from Mektron, 119 Kingston Road, Leatherhead, Surrey, KT22 7SU. The material has a dielectric constant of about 2.2 and is available in a range of thicknesses down to about 80 μm. Laminates have been made from this material with the use of an intermediate layer of fluorocarbon film (3M's type 6700 or Dupont FEP) placed between the layers, bonding being achieved with the joint application of heat and pressure. Bonding may advantageously be carried out in a nitrogen atmosphere.

Other suitable materials include P.T.F.E. sheet, Mylar, and Kaptan.

The lamination technique may also be applied as a continuous process, where appropriate, in place of the one off process in which a jig, as shown in FIGS. 3 and 4, is used

EXAMPLE

Resonators 4.76 mm diameter × 1.83 mm length were mounted by forming a laminate consisting of two outer retaining layers (2, 2') and a central supporting layer (4) of R T Duroid 5890. The outer layers being 76 μm thick, and the central layer 250 μm thick. Interlayers (5) of 3M's 6700 fluorocarbon film 35 μm thick were used between the Duroid sheets.

The laminate was produced using a pressure of 100 p.s.i. applied for 15 minutes at a temperature of 200° C.

The resulting laminate was found to be stable at elevated temperatures, and in particular showed no signs of warping after being heated to 128° C.

We claim:

1. A dielectric resonator mount having a laminar structure which comprises a polymeric support layer between two polymeric retaining layers wherein the support layer includes an aperture within which is located a dielectric resonator.

2. A dielectric resonator mount as claimed in claim 1 wherein all the layers are heat bonded together.

3. A dielectric resonator mount as claimed in claim 2 wherein said support and said retaining layers are all formed of substantially the same material, heat bonding between the layers being effected with the aid of intermediate layers of a different material of low dielectric loss positioned between said support layer and said retaining layers.

4. A dielectric resonator mount as claimed in claim 3 wherein said support and retaining layers are formed of polytetrafluoroethylene homopolymer and said intermediate layers are formed of tetrafluoroethylene copolymer.

5. A dielectric resonator mount as claimed in claim 4 wherein said polytetrafluoroethylene homopolymer contains a filler.

6. A dielectric resonator mount as claimed in claim 5 wherein said filler is glass.

7. A dielectric resonator mount as claimed in any one of the preceding claims wherein said retaining layers are each less than 100 μm thick.

8. A dielectric resonator mount as claimed in claim 7 wherein said support layer is between 150 and 300 μm thick.

9. A dielectric resonator mount as claimed in any one of claims 1 to 4 wherein said resonator is disposed symmetrically with respect to said support layer.

10. A microwave resonant cavity comprising a dielectric resonator mount as claimed in claim 1 mounted in a waveguide.

11. A microwave resonant cavity as claimed in claim 10 wherein opposite edges of said laminar structure are held in grooves in the walls of said waveguide.

12. A microwave resonant cavity as claimed in claim 10 or claim 11 wherein the dielectric resonator is mounted on the axis of said waveguide.

* * * * *